6/9/87 OR 4,672,170

United States Patent [19]

Speri

[11] Patent Number: 4,672,170

[45] Date of Patent: Jun. 9, 1987

[54] APPARATUS FOR THERMOCHEMICAL TREATMENTS OF METALS BY IONIC BOMBARDMENT

[75] Inventor: Roger Speri, Conflans Sainte Honorine, France

[73] Assignee: Societe Anonyme dite: Vide et Traitement, Neuilly-en-Thelle, France

[21] Appl. No.: 657,791

[22] Filed: Oct. 4, 1984

Related U.S. Application Data

[62] Division of Ser. No. 355,880, Mar. 8, 1982, Pat. No. 4,490,190.

[30] Foreign Application Priority Data

Mar. 31, 1981 [FR] France ..... 81 05107

[51] Int. Cl.[4] ..... B23K 15/00

[52] U.S. Cl. ..... 219/121 PT; 219/121 P; 219/121 EB; 219/121 PD; 204/192.31

[58] Field of Search ..... 219/121 PD, 121 PF, 219/121 PG, 121 P, 121 EB; 204/192 N, 298, 164; 313/231.31, 231.41

[56] References Cited

U.S. PATENT DOCUMENTS

| | | | |
|---|---|---|---|
| 4,094,764 | 6/1978 | Boucher | 204/192 N |
| 4,116,791 | 9/1978 | Zega | 204/192 N |
| 4,253,907 | 3/1981 | Parry et al. | 219/121 PF |
| 4,297,387 | 10/1981 | Beale | 204/192 N |
| 4,342,631 | 8/1982 | White et al. | 204/192 N |
| 4,348,577 | 9/1982 | Toyoda et al. | 219/121 PF |

*Primary Examiner*—M. H. Paschall

*Attorney, Agent, or Firm*—Scully, Scott, Murphy & Presser

[57] ABSTRACT

Apparatus for thermochemical treatment of metals with accurate control of the treatment temperature in a furnace having a structure similar to that of a classic furnace for thermal or thermochemical treatment in a rarified atmosphere, equipped with a controlled heater, and possibly a cooler, an anode, and a cathode supporting the pieces to be treated. A cold plasma is generated around the pieces to be treated by applying between the anode and the cathode a pulse train at a relatively high frequency and of very short pulse width in relation to pulse repetition rate.

3 Claims, 1 Drawing Figure

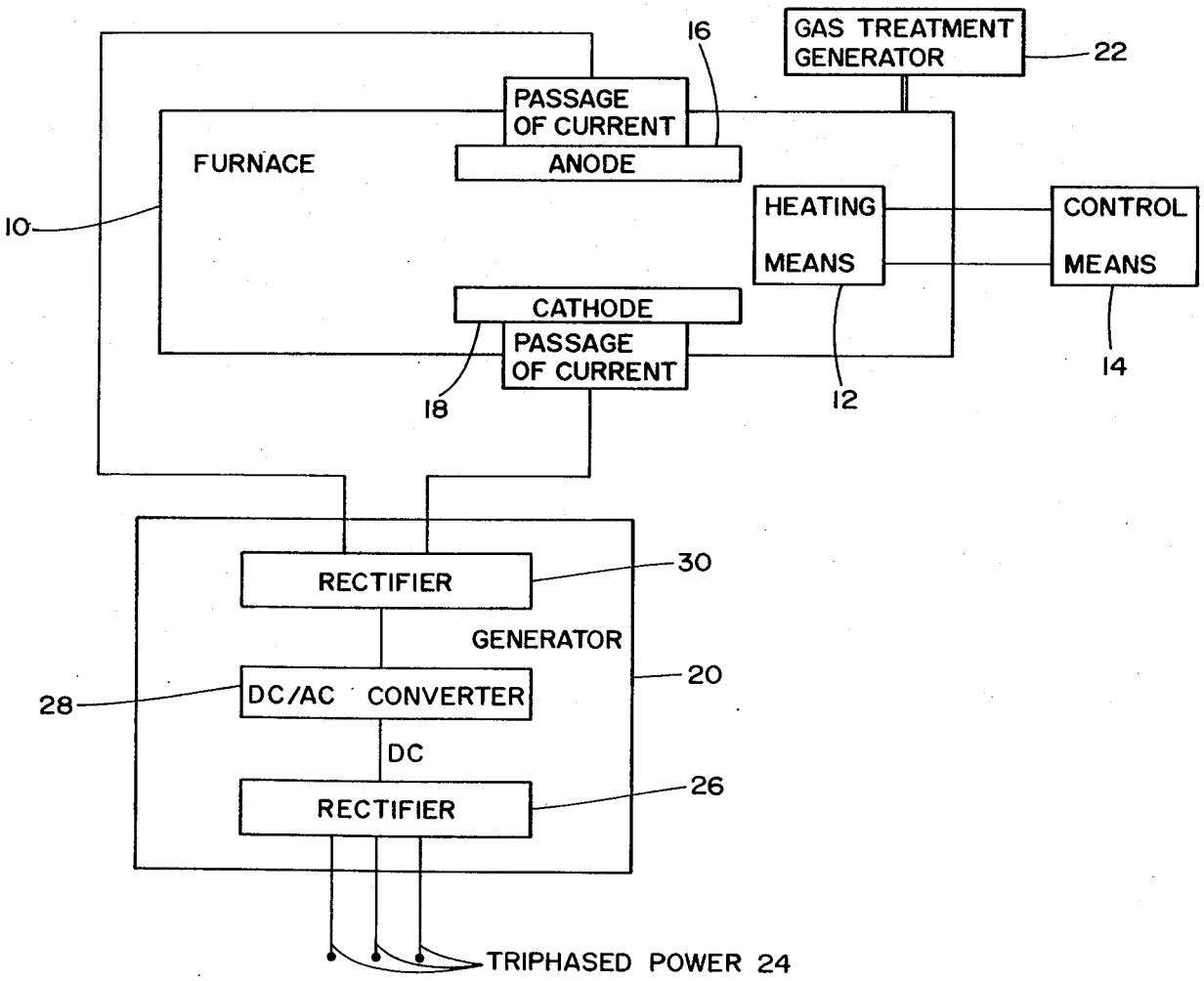
GAS TREATMENT GENERATOR
22
CONTROL MEANS
14
HEATING MEANS
12
16
PASSAGE OF CURRENT
ANODE
CATHODE
PASSAGE OF CURRENT
18
FURNACE
10
30
20
26
GENERATOR
RECTIFIER
DC/AC CONVERTER
DC
RECTIFIER
28
TRIPHASED POWER 24

APPARATUS FOR THERMOCHEMICAL TREATMENTS OF METALS BY IONIC BOMBARDMENT

This is a divisional of co-pending application Ser. No. 355,880 now U.S. Pat. No. 4,490,190 filed Mar. 15, 1982.

BACKGROUND OF THE INVENTION

The present invention relates to apparatus for thermochemical treatments of metal such as nitridation, carbidation, case-hardening, metallic deposion under a vacuum, etc . . . by ionic bombardment.

DESCRIPTION OF THE PRIOR ART

Generally, it is known that these treatments involve two principal factors, namely control of the treatment environment and control of the treatment temperature.

Thus, for example, in the case of a classical nitridation treatment, the treatment environment is obtained by passing ammonia over the pieces, which, in decomposing, release active nitrogen atoms. The treatment temperature, which is of the order of 570° C., is then obtained by placing the pieces in an electric furnace.

In the case of a nitridation treatment by ionic bombardment, the pieces to be treated are placed in an enclosure containing a gas ($NH_3$, molecular nitrogen, $H_2$, $CH_4$) at low pressure (0.1 to 10.torrs). This enclosure is equipped with an anode and a cathode, connected to a high voltage electric generator (between 300 and 1500 V). The cathode is constructed to support the pieces to be treated which are, consequently, brought to the cathode.

The treatment depends upon a luminescent discharge between the cathode and the anode, which is maintained to the limit of the generation of an arc.

During this treatment, there is created about the piece to be treated, a plasma composed of nitrogen ions which constitutes the treatment environment.

The treatment temperature is obtained by heat dissipation created by the bombardment of ions on the piece (kinetic energy).

The advantages of processes of thermochemical treatment by ionic bombardment in relation to other classical processes are well-known.

By contrast, this technique has associated therewith a number of difficulties, among which are:

- the impossibility of obtaining a uniformly controlled temperature of the pieces to be treated because of the plasma functioning as a heating means;
- the difficulty of developing systems to rupture the arc of high-powered generators;
- the difficulty of controlling the temperature of the pieces because the plasma controls the heating of the pieces;
- the necessity of simultaneously nitridating only pieces having a closely related geometry because of temperature differences among pieces having different geometry.

Thus, in an attempt to resolve these disadvantages and problems, it has been proposed to insert in the enclosure of a furnace a heating device which will preheat the piece or furnish a thermal support during treatment. However, such a solution does not allow, in the case of the classical supply of furnace electrodes, an accurate control over the temperature of the pieces, and a uniform temperature of the pieces.

Another solution proposed to obtain operation free from the risk of arc formation consists of utilizing, instead of a continuous current, pulses of current at a high voltage but the total energy of which is maintained at a predetermined value, so that it would not be possible to attain, in the curve of discharge voltage magnitude, the values thereof corresponding to the formation of an arc.

According to this technique, for the temperature of the pieces to be raised to the treatment temperature or even maintained at this temperature, in the case where the pieces have been preheated, it is necessary to utilize electrical pulses which are relatively large in relation to their period.

It appears, however, that this solution does not allow, either, the achievement of a uniform temperature of the pieces.

SUMMARY OF THE INVENTION

With the object of eliminating all of these disadvantages, the present invention proposes to render the two parameters of treatment totally independent, namely, the generation of the treatment environment, that is to say the plasma, and the heating to the treatment temperature of the pieces.

To this end, the subject invention utilizes properties relating to the time of generating plasma and to the duration of its existence. It is known that a plasma generated by a current pulse at high voltage remains in existence for a relatively long time (several hundred microseconds or so to several milliseconds) in relation to the time for generation of this plasma (several microseconds).

As a consequence, by generating a pulse train at a high frequency (the period of these pulses is close to the existence time or life duration of the plasma, that is to say from 100 microseconds to 10 milliseconds), and with a very short pulse width between 1 to 100 microseconds (longer then the creation time of the plasma), there is obtained in a continuous manner a cold plasma, that is to say, a plasma in which the thermal energy dissipated during the disassociation stays at a very low level and does not affect the characteristics of the treatment temperature, in the case of a thermochemical treatment.

BRIEF DESCRIPTION OF THE DRAWING

The drawing illustrates an exemplary embodiment of an apparatus for the thermochemical treatment of metal pieces by ionic bombardment.

DETAILED DESCRIPTION OF THE DRAWING

Referring to the drawing in detail, the drawing illustrates an apparatus for thermal treatment according to the present invention which utilizes a furnace 10 having a structure analagous to that of a classical furnace for thermal treatment or thermochemical treatment in a rarified atmosphere, equipped with controlled heating means 12, 14, and comprising, further, at least an anode 16 and a cathode 18 supporting the pieces to be treated. The process consists of generating at the pieces to be treated a cold plasma, such as previously defined, by applying between the anode and the cathode an electrical pulse train supplied by a generator 20 at a relatively high frequency and of a very short pulse width or duration and by heating the pieces by the aforesaid classical means of heating, so as to raise them to and maintain them at the treatment temperature.

This process presents multiple advantages.

Because the heating of the pieces is independent of the generation of the plasma, it is possible to use pulse generators having a very low power in relation to that which would otherwise be necessary.

The treatment temperature is easily and precisely controlled, by utilizing tested equipment of classic furnaces for thermal or thermochemical treatment.

The control of other treatment parameters is facilitated because one is able to simultaneously control the relation of the amplitude and the frequency of the pulses; and The risk of deterioration of or damage to the pieces by arc formation is totally eliminated because the plasma is generated by short duration pulses.

This process allows, furthermore, the elimination of the heterogenity of temperature in terms of the parameters related to the pieces, such as the form, the state, the phenomenon of a cathode hollowing during the rise in temperature, the dimensions of the different pieces, etc . . . .

The present invention relates equally to an installation for the thermochemical treatment by ionic bombardment applying the process according to the present invention.

As previously mentioned, this installation involves a furnace having a structure similar to that of a classic furnace of thermal or thermochemical treatment in a rarified atmosphere; this furnace comprising normal controlled or regulated means for heating by convection, by radiation, coherent or otherwise, or by induction, a gas treatment generator 22 and passages of current across the wall of the furnace and connected to the electrodes (anodes, cathodes) for the generation of the plasma.

These electrodes may be supplied with triphased 24 or single phased electrical power by means of generator 20 comprising a controlled rectifier 26 which allows the generation of continuous DC voltage, variable between zero and a predetermined upper voltage of the generator, allowing the conversion of this continuous DC voltage to AC voltage in a DC/AC converter 28 at a desired amplitude and frequency, then rectified by a rectifier 30 to obtain single polarity pulses at a high voltage on the order of 300 to 1500 V and a high frequency on the order of 100 hertz to 10 kilohertz which are applied to the furnace.

It should be noted that the adoption of a high-power plasma generator based on the same principle permits a mixed operation with both hot plasma and cold plasma Likewise, in this case, one can utilize independently, alternatively or even simultaneously during treatment, the two types of heating (normal heating means in the furnace and operation in a hot plasma mode).

I claim:

1. Apparatus for thermochemical treatment of metal pieces by ionic bombardment, including a furnace providing for thermal or thermochemical treatment of the metal pieces in a rarified atmosphere, equipped with a controlled heating means, an anode, a cathode, means for supporting the metal pieces to be treated on said cathode, means for generating at the metal pieces being treated a cold plasma, including a pulse train generator for generating and applying between the anode and the cathode an electrical pulse train in which the width of the pulses is from 1 to 100 microseconds, and the period between pulses is 100 microseconds to 10 milliseconds, and said controlled heating means heating the metal pieces independently from the action of the plasma to raise them to and maintain them at the treatment temperature.

2. Apparatus according to claim 1, characterized in that said pulse train generator operates from a three phased industrial power supply, and comprises a controlled rectifier which generates single polarity pulses at a voltage from 300 to 1500 V.

3. Apparatus according to claim 1, characterized in that said pulse train generator operates from a single phased industrial power supply, and comprises a controlled rectifier which generates single polarity pulses at a voltage from 300 to 1500 V.

* * * * *

UNITED STATES PATENT AND TRADEMARK OFFICE

CERTIFICATE OF CORRECTION

PATENT NO. : 4,672,170

DATED : June 9, 1987

INVENTOR(S) : Roger Speri

It is certified that error appears in the above-identified patent and that said Letters Patent is hereby corrected as shown below:

Item [30]:

Title Page, Foreign Application Priority Data should read

--March 13, 1981--

Signed and Sealed this

Fifteenth Day of December, 1987

*Attest:*

DONALD J. QUIGG

*Attesting Officer*

*Commissioner of Patents and Trademarks*